United States Patent [19]

Anleitner

[11] Patent Number: 4,580,314

[45] Date of Patent: Apr. 8, 1986

[54] SUCTION CLEANING DEVICE

[75] Inventor: John J. Anleitner, Valparaiso, Ind.

[73] Assignee: Michael J. Galanis, Valparaiso, Ind.

[21] Appl. No.: 674,327

[22] Filed: Nov. 23, 1984

[51] Int. Cl.[4] ..... A47L 9/02

[52] U.S. Cl. ..... 15/415 R; 15/340; 15/346; 15/418; 15/420

[58] Field of Search ..... 15/340, 345, 346, 415 R, 15/418, 419, 420

[56] References Cited

U.S. PATENT DOCUMENTS

| | | | |
|---|---|---|---|
| 514,678 | 2/1894 | Furnas | 15/340 X |
| 978,916 | 12/1910 | Matchette . | |
| 1,745,355 | 2/1930 | Cooper . | |
| 3,201,819 | 8/1965 | Wilgus | 15/340 X |
| 3,238,557 | 3/1966 | Foster | 15/339 |
| 3,605,170 | 9/1971 | Hank et al. | 15/346 |
| 3,662,427 | 5/1972 | Hanna | 15/340 X |
| 4,138,762 | 2/1979 | Jost | 15/419 |
| 4,359,801 | 11/1982 | Tate | 15/346 |
| 4,466,156 | 8/1984 | Blehert | 15/346 |

FOREIGN PATENT DOCUMENTS

| | | | |
|---|---|---|---|
| 1475000 | of 1966 | France . | |
| 613735 | 10/1979 | Switzerland . | |
| 926968 | 5/1963 | United Kingdom | 15/415 X |

*Primary Examiner*—Chris K. Moore

*Attorney, Agent, or Firm*—Wood, Dalton, Phillips, Mason & Rowe

[57] ABSTRACT

A suction cleaning device adapted to be moved over a surface to remove loose debris therefrom and for use in a system including a suction duct leading to a source of high velocity air vacuum. A frame defines a housing having a substantially closed top. A plurality of elongated rollers are journalled on the frame within the housing and extending generally perpendicular to a forward direction of travel of the device for sealing as the device moves over the surface. Upper seals extend lengthwise between adjacent rollers and spaced from the surface. Surface seals extend between adjacent ends of selected pairs of the elongated rollers, whereby the rollers, the upper seals, the surface seals and the surface itself substantially define the bounds of a tortuous air flow path generally parallel to and over the surface in a circuitous route between the rollers. An air inlet is located forwardly of the housing at one end of the tortuous air flow path. An air outlet is located rearwardly of the inlet, with the tortuous air flow path following the circuitous route around the outlet and between the rollers.

21 Claims, 11 Drawing Figures

FIG. 3
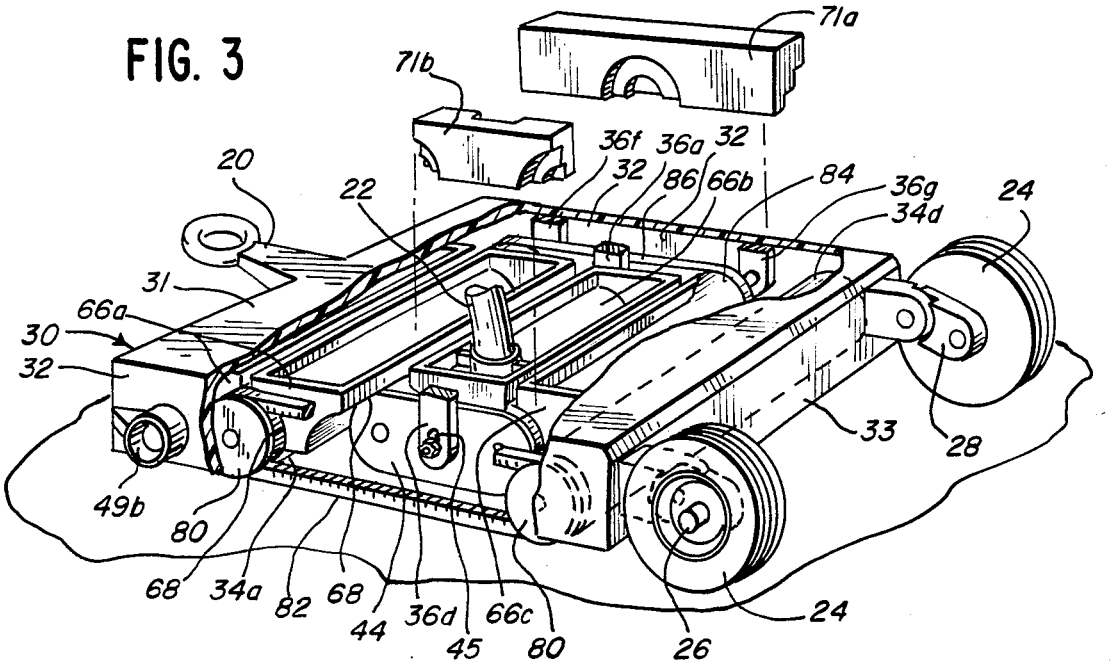
FIG. 4
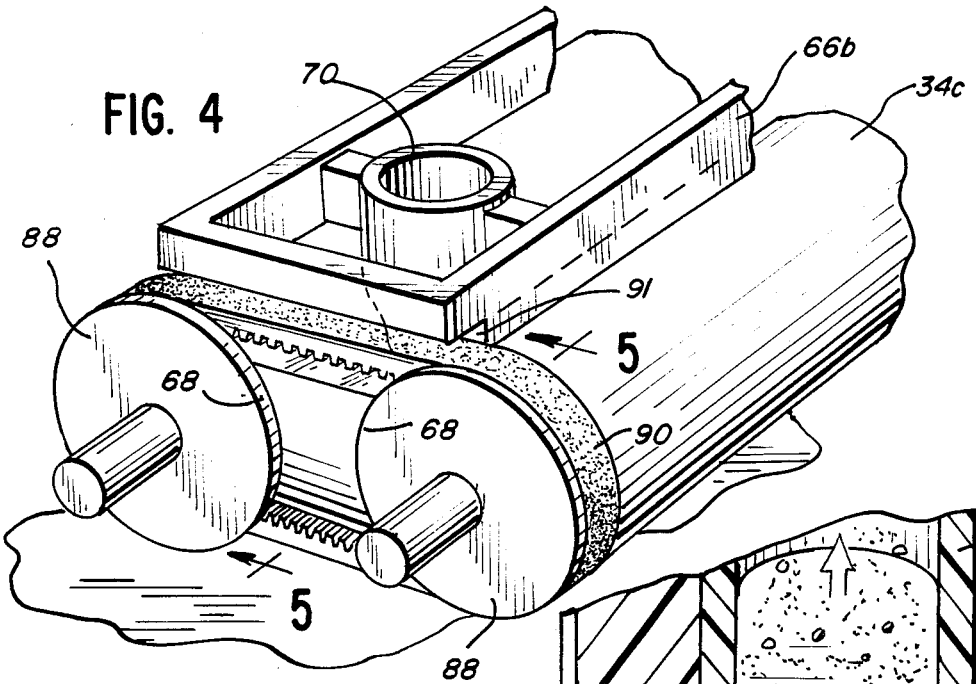
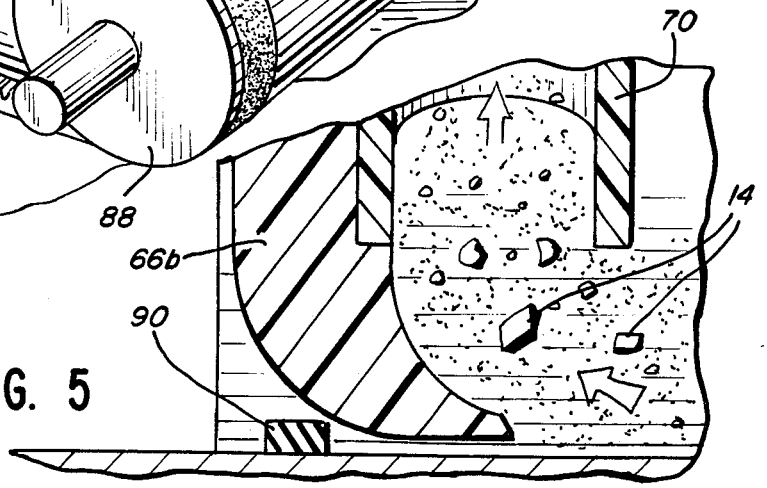
FIG. 5

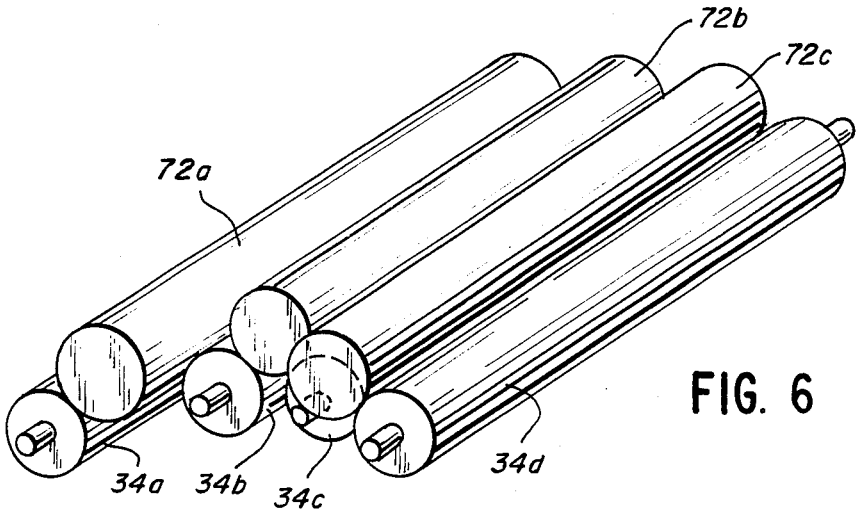
FIG. 6
FIG. 7
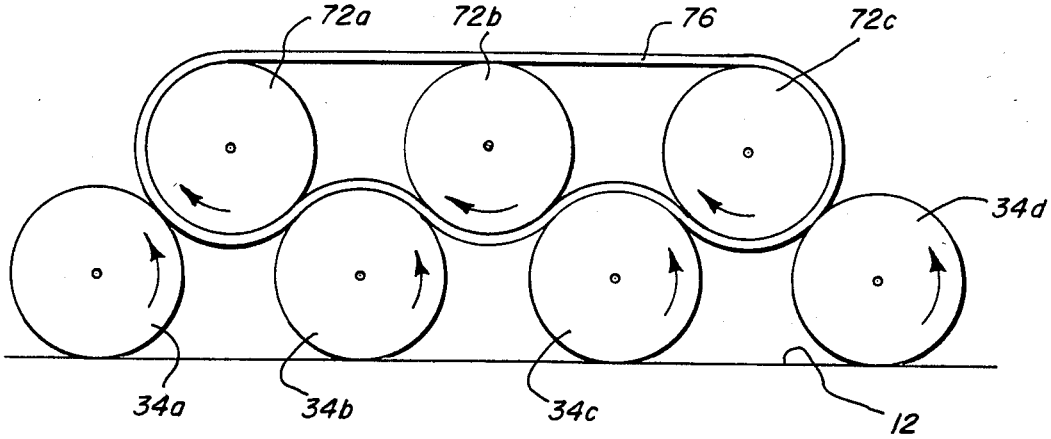
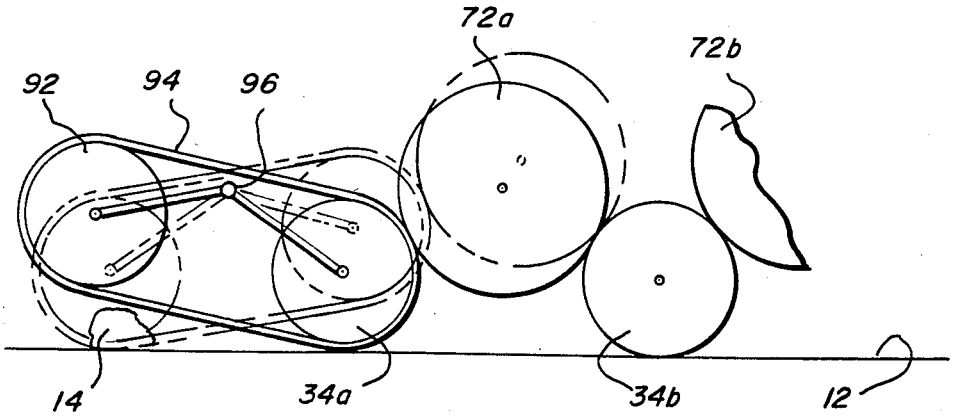
FIG. 8

SUCTION CLEANING DEVICE

BACKGROUND OF THE INVENTION

This invention relates to a suction cleaning device and, more particularly, to a cleaning device which is mobile and adapted for use with very high velocity air vacuum sources.

The invention is directed to providing an added and new capability for high velocity vacuum cleaning systems such as in the vacuum truck industry. Presently, "vacuum trucks" are used in industrial cleaning applications, but the jobs of cleaning large surface areas have mostly been restricted to conventional sweepers, such as known street sweepers or the like. A restricted use area has resulted because, although vacuum trucks create tremendous movement of air with the power to move practically any loose material, such systems have been restricted to the relatively small area of a suction hose located at the rear of a truck. In those instances where a suction hose is used for street sweeping, for instance, or other surface cleaning uses, auxiliary brushes or baffles have been used to direct the debris to the vacuum hose entry. Little or no attempts have been made to effectively spread this high power source over an area large enough to make a practical tool in cleaning larger surface areas without auxiliary brushes or baffles. The brushes are used to disturb the material from the surface and direct it to an area of high vacuum force. This is a costly process because of the constant friction and replacement of parts, resulting in high maintenance costs in addition to the high initial outlay cost of conventional street sweepers.

The present invention contemplates utilizing the high velocity air flow of such vacuum systems as the actual sweeping medium to clean large surface areas. the air velocity created is actually so great that the system can pick up medium sized stones and debris. Because of the use of a vacuum hose with very large positive displacement blowers, and with the hose having a relatively small cross-sectional dimension, such systems heretofore have not been used effectively for cleaning or sweeping considerably large surface areas. The debris normally is accumulated onto a pile or, in mobile units, directed toward a single location by brushes or baffles, and then picked up by the vacuum hose. The present invention provides a device which has various rollers and seal means which confine the high velocity air flow as the moving force to clean surface areas.

SUMMARY OF THE INVENTION

One object, therefore, of the present invention is to provide a new and improved suction cleaning device of the character described.

Another object of the invention is to provide a suction cleaning device which utilizes high velocity air flow as the sweeping medium to clean considerable surface areas.

In the exemplary embodiment of the invention, a suction cleaning device is disclosed and is adapted to be moved over a surface to remove loose debris therefrom, including use in a system having a suction duct leading to a source of high velocity air vacuum. A frame defines a housing having a substantially closed top. A plurality of rollers are journalled on the frame within the housing for sealing as the device moves over the surface. Means define a tortuous air flow path between the rollers generally parallel to and over the surface, including means for sealing a substantial portion of the tortuous air flow path so that it is exposed only to the surface. Air inlet means is provided to the tortuous air flow path, and air outlet means is provided from the path spaced from the air inlet means and in communication with the suction duct leading to the high vacuum air source.

As disclosed herein, the rollers are elongated in a direction generally perpendicular to a forward direction of travel of the device, and the tortuous air flow path follows a circuitous route between and around the rollers. The inlet means is located forwardly of the housing at one end of the tortuous air flow path, and the outlet means is located rearwardly of the inlet means whereby the air flow path follows a route around the outlet means.

Surface seal means extend between adjacent ends of selected pairs of elongated rollers. Upper seal means extend lengthwise between adjacent rollers and spaced from the surface to be cleaned. Therefore, the rollers, the upper seal means, the surface seal means and the surface itself define the bounds of the tortuous air flow path.

In one embodiment of the invention, the upper seal means comprise floating wedge members extending lengthwise between and resting on adjacent pairs of elongated rollers. In another embodiment of the invention, the upper seal means comprise floating roller members extending lengthwise between and in rolling contact with adjacent pairs of elongated rollers. A continuous sealing band may extend around the composite periphery of the floating roller members and engageable with the upper peripheries of the elongated ground-engaging rollers. In a further embodiment, integral portions of the housing itself form the upper seal means.

Other objects, features and advantages of the invention will be apparent from the following detailed description taken in connection with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 3 is a broken-away perspective view of the device illustrating certain of the interior components thereof;

FIG. 4 is a fragmented perspective view, on an enlarged scale, illustrating the surface seal means and upper seal means in conjunction with a pair of the ground-engaging rollers;

FIG. 5 is a fragmented vertical section, on a further enlarged scale, taken generally along line 5—5 of FIG. 4;

FIG. 6 is a somewhat schematic perspective view illustrating the use of roller members as the upper seal means for the ground-engaging rollers;

FIG. 7 is a somewhat schematic end elevation, on an enlarged scale, illustrating a sealing band about the upper seal rollers as incorporated in FIG. 6;

FIG. 8 is a somewhat schematic view of the use of a pair of tandem rollers at the forward or leading edge of the device;

DETAILED DESCRIPTION OF THE INVENTION

Figure 1:
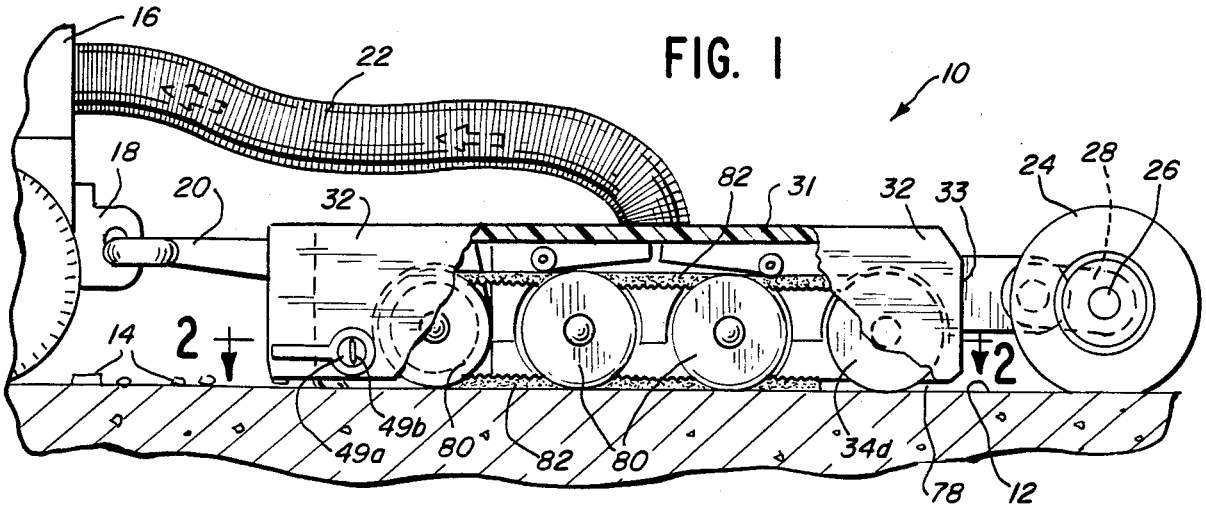
FIG. 1 is a fragmented side elevational view of a suction cleaning device embodying the concepts of the present invention, as an accessory to be drawn behind a vacuum truck.

Referring to the drawings in greater detail, and first to FIG. 1, the invention is shown in one form of a suction cleaning device, generally designated 10, adapted to be moved over a surface 12 to remove loose debris 14 therefrom. The device is illustrated as an attachment for towing behind a large vacuum truck 16 which is equipped with very large positive displacement blowers usually driven by an auxiliary engine. As is known, the blower compresses air out of a truck compartment, creating a large pressure differential within the system. Such systems are capable of vacuums as high as 7,500 cubic feet per minute which can create an air velocity as high as 20,000 feet per minute.

Vacuum truck 16 has a hitch which can be coupled to a complementary tongue hitch 20 projecting forwardly of suction cleaning device 10. A suction duct 22 communicates between vacuum truck 16 and cleaning device 10. A pair of rear support wheels 24 also are provided at the rear of the cleaning device on axles 26 supported by pivot arms 28. The rear support wheels may be raised and lowered by conventional hydraulic means (not shown) to adjust the working height of the cleaning device. The support wheels substantially bear the weight of the cleaning device, as will be described in greater detail hereinafter.

Suction cleaning device 10 includes a frame defining a housing, generally designated 30, which has a closed top defined by a wall 31, a pair of generally parallel front-to-rear side walls 32 and a rear wall 33. A plurality of rollers 34*a*, 34*b*, 34*c* and 34*d* are journalled on the frame within housing 30, as described hereinafter for sealing as the cleaning device moves over surface 12. Rear support wheels 24 are positioned such that rollers 34*a*–34*d* maintain sealing engagement with surface 12, but the support wheels bear the substantial weight of the device and present excessive wear of the rollers. The rollers should be fabricated of durable and abrasion resistant material, such as urethane.

Figure 2:
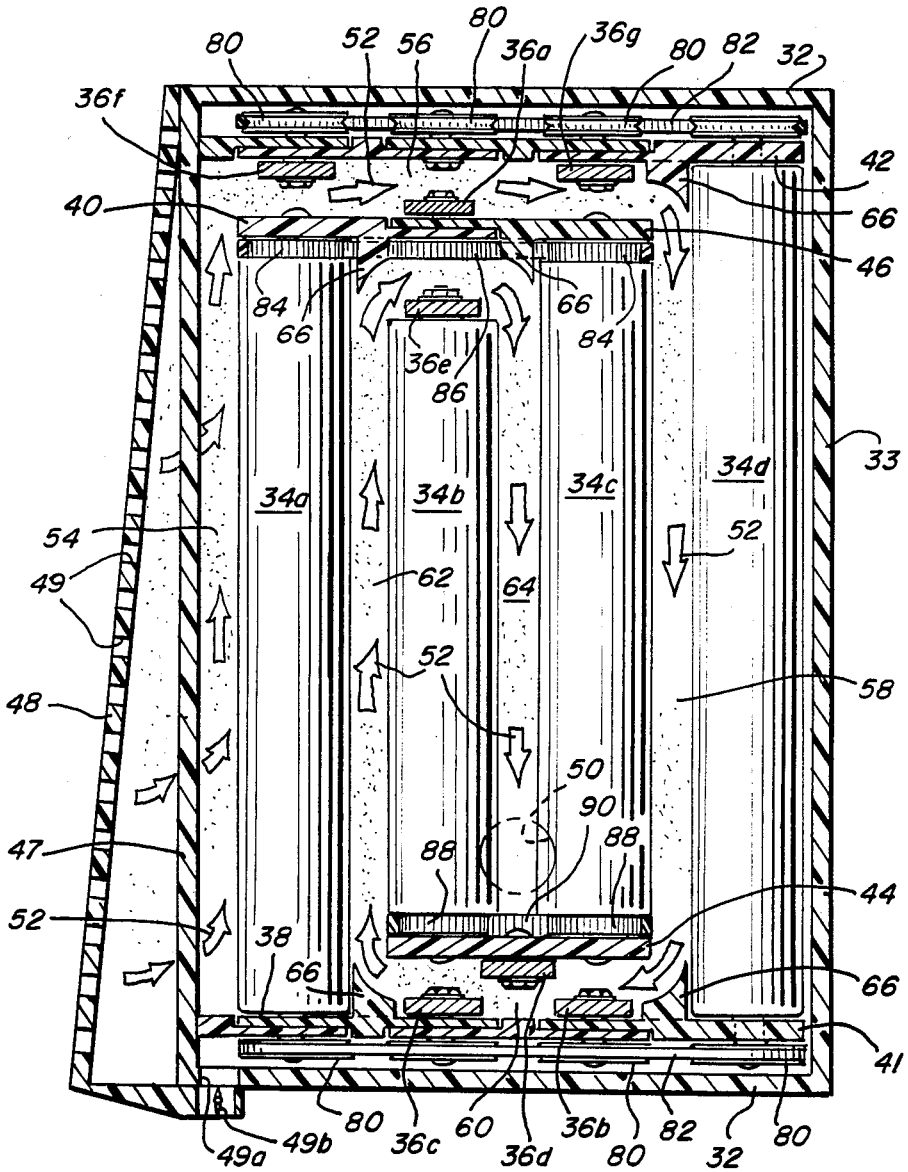
FIG. 2 is a horizontal section taken generally along line 2—2 of FIG. 1.

Referring to FIG. 2, the frame of device 10 includes interior support brace member 36*a*, 36*b*, 36*c*, 36*d*, 36*e*, 35*f* and 36*g* which are formed integral with and depend downwardly from top 31 of housing 30 on the interior thereof. It can be seen that rollers 34*a*–34*d* are elongated in a direction generally perpendicular to a forward direction of travel of the device. Roller 34*a* is the forward roller, roller 34*d* is the rear roller and rollers 34*b*, 34*c* are disposed therebetween. Roller 34*a* is mounted at one end by an arm 38 to brace 36*c* and an arm 40 at the opposite end to brace 36*a*. Rear roller 34*d* is mounted at one end by an arm 41 to brace 36*b* and at the other end by an arm 42 to brace 36*g*. Roller 34*b* is mounted at one end by an arm 44 to brace 36*d* and at the opposite end directly to brace 36*e*. Roller 34*c* also is mounted at one end by arm 44 to brace 36*d* and at the opposite end by an arm 46 to brace 36*a*. Each roller is mounted within slots 45 (see FIG. 3) in the respective braces to provide lost motion means permitting independent reaction of the rollers to surface contours.

The front of housing 30 is defined by a pivot flap 47 which has minimal leakage thereunder. The flap may be fabricated of strong rubber-like material. An air intake 49*a* is provided at one end of the flap, through the housing between the flap and roller 34*a*. A valve 49*b* is provided in air intake 49*a*. The valve can adjust the amount of air to be taken through the air intake versus that which passes under flap 47. For instance, should the device encounter water on surface 12 which would flow under flap 47, the device could "starve" for air capacity. Thus, the valve would be opened considerably. This is particularly applicable since the device is capable of picking up liquids or slurries, such as grease or sludge, as well as dry debris. Of it the flap becomes worn, the valve would be opened so that more air passes across the front of roller 34*a*. A perforated rake 48 is angled toward one side of the device at the front thereof to direct larger pieces of debris to one side of the device. The size of apertures 49 in the rake determine the size of debris permitted to pass under flap 47.

An outlet means 50 is located rearwardly of the inlet means at a "closed end" of spacing between rollers 34*b*, 34*c* and in communication with suction duct 22. It can be seen in FIG. 2 that rear roller 34*d* is the longest roller and extends completely across the rear of housing 30. Forward roller 34*a* is the next largest roller, followed in size by smaller roller 34*c* immediately forward of rear roller 34*d*, and then followed in size by the smallest roller 34*b* which is located immediately behind forward roller 34*a*. Consequently, it can be seen by arrows 52 that a tortuous air flow path is created between and around the respective rollers.

More particularly, the tortuous air flow path follows a circuitous route beginning through the inlet means at the front of the housing in a space 54 in front of forward roller 34*a*. The path continues down one side of the housing in space 56 and into a transverse, elongated space 58 in front of rear roller 34*d*. The path continues through a space 60 along the opposite side of the housing into another transverse space 62 in front of roller 34*b*, around that roller and into a central transverse space 64 which leads to outlet means 50. It can be seen that this circuitous route of the tortuous air flow path between and around the rollers, as well as around outlet means 50, results in a considerably elongated flow path. With the very high velocity air speed, the debris not only is picked up from surface 12, but the debris itself acts as a sweeping medium, along with the high velocity air, to efficiently clean the surface of all loose debris and channel the debris to outlet means 50 whereupon it is drawn through suction duct 22 into vacuum truck 16.

Arms 38 and 40 for roller 34*a*, arms 41 and 42 for roller 34*d* and arm 46 for roller 34*c* all have baffle portions 66 with curved inner surfaces to define smooth corners for the tortuous air flow path described above.

Various seal means are provided in operative association with rollers 34*a*–34*d* to further define the bounds of the tortuous air flow path and to prevent as much leakage as possible of air between and around the rollers, thereby confining the air flow to the tortuous path and insuring powerful sweeping action of the air. First, upper seal means extend lengthwise between adjacent rollers and spaced from surface 12. More particularly, referring to FIGS. 3 and 4, floating wedge members 66*a*, 66*b* and 66*c* extend lengthwise between repective adjacent pairs of rollers. Wedge member 66*a* is disposed between rollers 34*a* and 34*d*, wedge member 66*d* is disposed between rollers 34*b* and 34*c*, and wedge member 66*c* is disposed between rollers 34*c* and 34*d*. Each wedge member has concave surfaces 68 complementary to the circular peripheral surfaces of the rollers to provide a seal therewith. The wedge members are fabricated of durable and abrasion resistant material, such as urethane, and may be spring loaded between the wedge members and the underside of top wall 31 of housing 30. The wedge members alternately may rest by gravity on the respective rollers. However, the suction caused by the air flow itself facilitates drawing the wedge members into sealing engagement with the rollers. The central wedge member between rollers 34*b*, 34*c* is provided with a socket 70 for receiving air duct 22. This also can be seen in FIG. 5 where debris 14 is shown moving under the vacuum force of the air flow upwardly through socket 70 and into the air duct. As seen in FIG. 3, sealing blocks 71*a* and 71*b* are shaped complementary to spaces 56 and 60 (FIG. 2), respectively, on the inside of housing 30 to seal above those areas of the air flow path. The sealing blocks are fixed to the underside of the top wall of the housing.

FIG. 6 shows an alternate form of upper seal means wherein upper floating roller members 72*a*, 72*b* and 72*c* are disposed in similar positions as floating wedge members 66*a*–66*c*. Roller member 72*a* is disposed between rollers 34*a* and 34*b*, roller member 72*b* is disposed between rollers 34*b* and 34*c*, and roller member 72*c* is disposed between rollers 34*c* and 34*d*. The roller members operate similar to wedge members 66*a*–66*c* described above to seal with the circular peripheries of rollers 34*a*–34*d*. Of course, the air outlet means (e.g. outlet 70 in wedge member 66*d* in FIG. 4) must be relocated to the end of roller 72*b* in this embodiment.

FIG. 7 shows still a further embodiment of an upper seal means wherein a continuous sealing belt 76 extends around the composite periphery of floating roller members 72*a*–72*c* which were described in relation to FIG. 6. The band itself is in engagement with the circular peripheries of rollers 34*a*–34*d*, and the band extends the full length of the rollers.

Referring back to FIGS. 1–5, surface seal means also is provided and extends between adjacent ends of respective pairs of rollers to prevent significant air leakage from around the underside of housing 30. For instance, it can be seen at 78 in FIG. 1 that clearance is provided between the lower peripheries of rollers 34*a*–34*d* and the underside of housing 30. A major portion of this clearance space is sealed by the surface seal means. More particularly, as best seen in FIGS. 1 and 2, a plurality of pulleys 80 (four on each side) are journalled on the roller shafts or on the support arms for the rollers on the inside of housing 30. A flexible belt 82 is wrapped around the composite periphery of the pulleys on each side of the housing. It can be seen in FIG. 1 that the flexible belt is at least as thick as clearance 78 between the underside of the housing and surface 12.

Referring to FIGS. 2 and 3, pulleys 84 are disposed at adjacent ends of rollers 34*a*, 34*c* for rotation therewith, along with a third pulley 86 journalled on arms 40, 46. A flexible belt 86 is wrapped around the composite periphery of pulleys 84, 86 and operate in a similar sealing fashion as described in relation to flexible belt 82, above.

Lastly, a pair of pulleys 88 are disposed at adjacent ends of rollers 34*b*, 34*c* for rotation therewith (see particularly FIG. 4). A flexible belt 90 is wrapped around pulleys 88 and form surface seal means as described above in relation to flexible belts 82, 86. As seen in FIG. 4, all of the belts are disposed within the pulleys so as to be flush with the outer circular peripheries of the rollers. This insures that the pulleys do not interfere with the ground-sealing of the rollers themselves with surface 12. The wedge members also are provided with grooves, as at 91 in FIG. 4, for accommodating the belts.

Therefore, it can be seen that the bounds of the tortuous air flow path are substantially defined by rollers 34*a*–34*d*, the upper seal means (e.g. floating wedge members 66*a*–66*c*) and the surface seal means at the ends of the rollers (e.g. flexible belts 82, 86 and 90).

There may be occasion when the cleaning device is used in areas where substantial sized items of debris are encountered. In order to prevent the entire cleaning device from "bouncing" under such circumstances, means may be provided to accommodate large items of debris. This means is shown somewhat schematic in FIG. 8 wherein front roller 34*a* is mounted in tandem with an auxiliary front roller 92. Front roller 34*a* and auxiliary front roller 92 are surrounded by a continuous belt 94 which extends lengthwise of the rollers. The tandem pair of rollers are pivoted at 96 and are joined for conjoint pivoting action by appropriate support arms which are not shown to avoid detracting from a clear illustration. Weight means also may be provided to normally maintain roller 34*a* in engagement with surface 12. When a relatively large item of debris 14 (FIG. 8) is encountered, the item will be directed under belt 94 which may be somewhat flexible. As the item of debris moves rearwardly (i.e. the cleaning device moving forwardly), front roller 34*a* can pivot upwardly as auxiliary front roller 92 pivots downwardly as indicated by the phantom position shown in FIG. 8. This happens fairly rapidly and a seal is immediately created by auxiliary front roller 92 and belt 94 in front of the debris to immediately start the debris channeling through the tortuous air flow path. Since upper floating seal roller members 72*a*–72*c* can move independently, front roller members 72*a* also can move upwardly as shown in phantom in FIG. 8.

Figure 9:
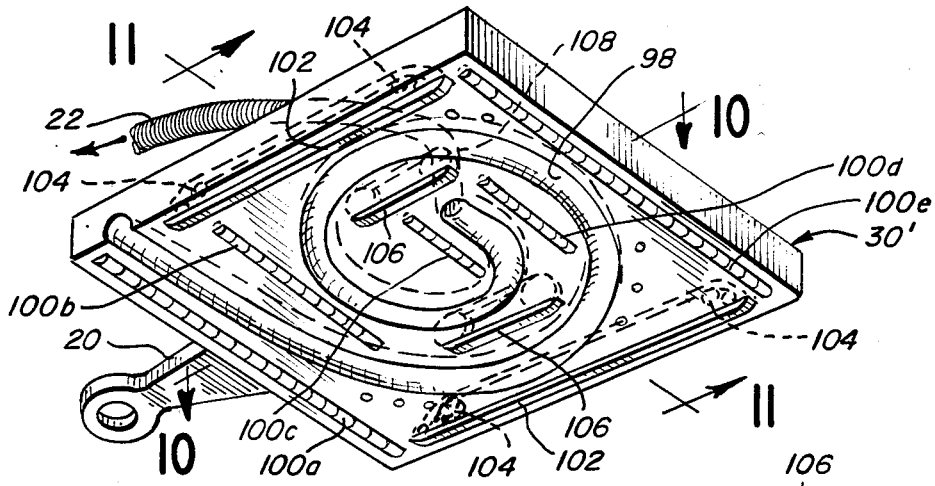
FIG. 9 is a perspective view of the underside of a modified form of the device.
Figure 10:
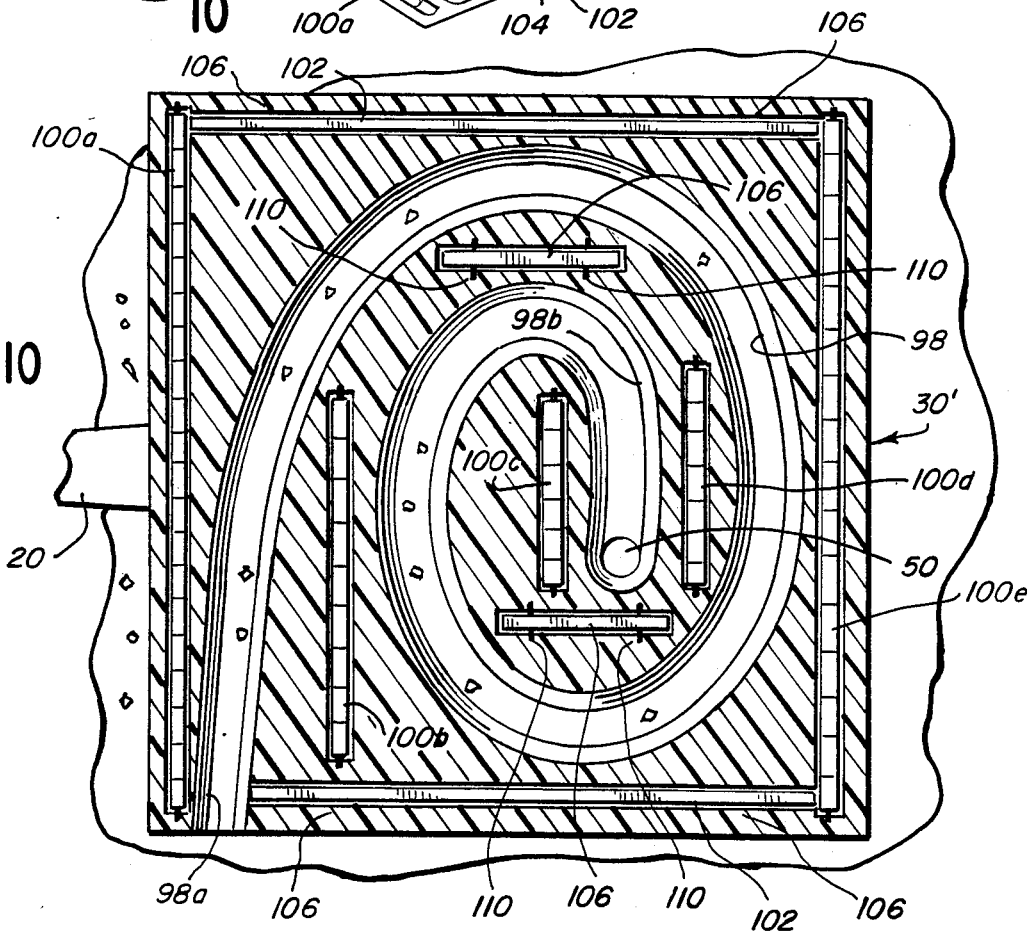
FIG. 10 is a horizontal section, on an enlarged scale, taken generally along line 10—10 of FIG. 9.
Figure 11:
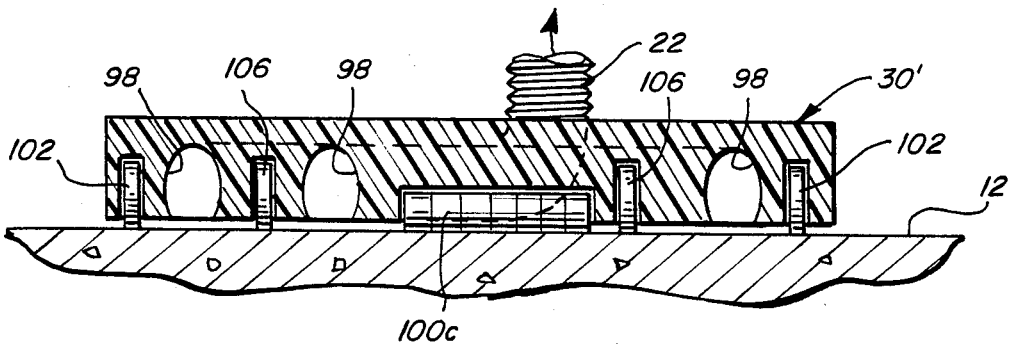
FIG. 11 is a vertical section, on an enlarged scale, taken generally along line 11—11 of FIG. 9.

FIGS. 9–11 show an alternate form of the invention wherein housing 30' is substantially solid and defines a smooth tortuous air flow path 98 which follows a circuitous route from a forward transverse portion 98*a* around outlet means 50 to a central terminal portion 98*b* leading to the outlet means. As seen best in FIG. 11, the air flow path is defined by grooves cut integrally into the substantially solid housing. This eliminates the floating upper seal means described in relation to FIGS. 1–7 because the seal means, in essence, comprises the housing itself. Transverse rollers 100*a*–100*e* are provided for moving the cleaning device over surface 12. Front roller 100*a* seals to-ground the front of the cleaning device, and rear roller 100*e* seals to-ground the trailing end of the cleaning device. Side belts 102 pass around pulleys 104 appropriately journalled on shafts 106 (FIG. 10) on the underside of the housing. Belts 102 seal the sides of the cleaning device to surface 12 as described above in relation to flexible belts 82 in relation to FIGS. 1–4. The belts, in combination with front and rear rollers 100*a* and 100*d*, respectively, insure that a minimal amount of air leakage can occur to thereby insure maximum air velocity within the tortuous air flow path.

Some ground sealing also is provided interiorly by rollers 100*b* and 100*c*, in combination with interior flexible belts 106 which pass around pulleys 108 (FIG. 9) journalled on shafts 110 (FIG. 10). Although the grooves formed integrally with the underside of housing 30', which define tortuous air flow path 98, are effective to concentrate the high velocity air flow therewithin, rollers 100*a*–100*d*, along with belts 102 and 106, further restrict the air flow to the tortuous path.

In view of the foregoing, it can be seen that I have provided a new and improved suction cleaning device which is utilized with a high velocity air suction source to effectively remove loose debris from suface areas by a sweeping action which employs the air itself, along with the moving debris, to disrupt and remove substantially all loose debris from the surface to be cleaned.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In a suction cleaning device adapted to be moved over a surface to remove loose debris therefrom, including a suction duct leading to a source of high velocity air vacuum, comprising:

a frame defining a housing having a substantially closed top;

a plurality of rollers journalled on said frame within the housing for supporting and moving the device over said surface;

means defining a tortuous air flow path between said rollers generally parallel to and over said surface, including means for sealing a substantial portion of said tortuous air flow path so that it is exposed only to said surface;

air inlet means to said tortuous air flow path; and air outlet means from said tortuous air flow path spaced from said air inlet means and in communication with said suction duct leading to said high vacuum air source.

2. The suction cleaning device of claim 1 wherein said rollers are elongated in a direction generally perpendicular to a forward direction of travel of the device, and said tortuous air flow path follows a circuitous route between the rollers.

3. The suction cleaning device of claim 2 wherein said inlet means is located forwardly of said housing at one end of the tortuous air flow path, said outlet means is located rearwardly of said inlet means, and said air flow path follows a route around said outlet means.

4. The suction cleaning device of claim 2 wherein said rollers seal to said surface, and including auxiliary seal means engageable with the surface and extending in front-to-rear direction between adjacent ends of at least some of said elongated rollers.

5. The suction cleaning device of claim 1 wherein said rollers are elongated in a direction generally perpendicular to a forward direction of travel of the device, and including upper seal means extending lengthwise between adjacent rollers and spaced from said surface, whereby the rollers, the upper seal means and the surface substantially define the bounds of said tortuous air flow path.

6. The suction cleaning device of claim 5 wherein said upper seal means comprise a wedge member extending lengthwise between and in engagement with an adjustment pair of elongated rollers.

7. The suction cleaning device of claim 5 wherein said upper seal means comprise a roller member extending lengthwise between and in rolling contact with an adjacent pair of elongated rollers.

8. The suction cleaning device of claim 7, including a plurality of said roller members between a plurality of said pairs of elongated rollers, with a continuous sealing band extending around the composite periphery of said roller members and engageable with the upper peripheries of said elongated rollers.

9. The suction cleaning device of claim 5 wherein said upper seal means comprise integral portions of said housing.

10. The suction cleaning device of claim 1 wherein said rollers are elongated in a direction generally perpendicular to a forward direction of travel of the device, and including surface seal means extending between adjacent ends of selected pairs of said elongated rollers.

11. The suction cleaning device of claim 10, including upper seal means extending lengthwise between adjacent rollers and spaced from said surface, whereby the rollers, the upper seal means, the surface seal means and the surface substantially define the bounds of said tortuous air flow path.

12. The suction cleaning device of claim 1 wherein said inlet means is defined by an elongated flap member extending along the front of said housing spaced from and generally parallel to an elongated front one of said rollers.

13. The suction cleaning device of claim 1 wherein said rollers are elongated in a direction generally perpendicular to a forward direction of travel of the device, including a tandem pair of front rollers surrounded by a continuous band with the rollers pivotal in tandem about a pivot point located between the rollers whereby the front roller of said tandem pair can pivot over a relatively large item of debris while the rear roller maintains its surface seal and vice versa.

14. In a suction cleaning device adapted to be moved over a surface to remove loose debris therefrom, including a suction duct leading to a source of high velocity air vacuum, comprising:

a frame defining a housing having a substantially closed top;

a plurality of elongated rollers journalled on said frame within the housing and extending generally perpendicular to a forward direction of travel of the device for supporting and moving the device over said surface;

upper seal means extending lengthwise between adjacent rollers and spaced from said surface;

surface seal means extending between adjacent ends of selected pairs of said elongated rollers, whereby the rollers, the upper seal means, the surface seal means and the surface itself substantially define the bounds of a tortuous air flow path generally parallel to and over said surface in a circuitous route between the rollers;

air inlet means located forwardly of said housing at one end of the tortuous air flow path; and air outlet means located rearwardly of said inlet means, said tortuous air flow path following the circuitous route around said outlet means and between said rollers.

15. The suction cleaning device of claim 14 wherein said upper seal means comprise a wedge member extending lengthwise between and in engagement with an adjacent pair of elongated rollers.

16. The suction cleaning device of claim 14 wherein said upper seal means comprise a roller member extending lengthwise between and in rolling contact with an adjacent pair of elongated rollers.

17. The suction cleaning device of claim 16, including a plurality of said roller members between a plurality of said pairs of elongated rollers, with a continuous sealing band extending around the composite periphery of said roller members and engageable with the upper peripheries of said elongated rollers.

18. The suction cleaning device of claim 14 wherein said upper seal means comprise integral portions of said housing.

19. The suction cleaning device of claim 14 wherein said surface seal means comprise continuous bands extending around adjacent ends of said selected pairs of said elongated rollers.

20. The suction cleaning device of claim 14 wherein said inlet means is defined by an elongated flap member extending along the front of said housing spaced from and generally parallel to an elongated front one of said rollers.

21. The suction cleaning device of claim 14, including a tandem pair of front rollers surrounded by a continuous band with the rollers pivotal in tandem about a pivot point located between the rollers whereby the front roller of said tandem pair can pivot over a relatively large item of debris while the rear roller maintains its surface seal and vice versa.

* * * * *